US008366346B2

(12) United States Patent
DiTullio

(10) Patent No.: US 8,366,346 B2
(45) Date of Patent: Feb. 5, 2013

(54) STORM WATER CHAMBER WITH FLOOR LINER

(76) Inventor: Robert J. DiTullio, Warren, CT (US)

( * ) Notice: Subject to any disclaimer, the term of this patent is extended or adjusted under 35 U.S.C. 154(b) by 264 days.

(21) Appl. No.: 12/814,128

(22) Filed: Jun. 11, 2010

(65) Prior Publication Data

US 2011/0305512 A1 Dec. 15, 2011

(51) Int. Cl.
*E02B 13/00* (2006.01)

(52) U.S. Cl. ..... 405/43

(58) Field of Classification Search ..... 405/36, 405/38–41, 43, 45, 47, 49, 124, 126
See application file for complete search history.

(56) References Cited

U.S. PATENT DOCUMENTS

| | | | | |
|---|---|---|---|---|
| 980,442 | A * | 1/1911 | Schlafly | 405/48 |
| 1,040,442 | A * | 10/1912 | Shannon | 285/405 |
| 1,071,185 | A * | 8/1913 | Shannon | 285/405 |
| 2,153,789 | A | 4/1939 | Carswell et al. | |
| 2,433,300 | A * | 12/1947 | Shafer | 405/47 |
| 2,767,801 | A | 10/1956 | Eads | |
| 3,897,090 | A | 7/1975 | Maroschak | |
| 3,926,222 | A | 12/1975 | Shroy et al. | |
| 4,245,924 | A * | 1/1981 | Fouss et al. | 405/45 |
| 4,360,042 | A * | 11/1982 | Fouss et al. | 138/119 |
| 5,087,151 | A | 2/1992 | DiTullio | |
| 5,156,488 | A | 10/1992 | Nichols | |
| 5,419,838 | A | 5/1995 | DiTullio | |
| 5,773,756 | A | 6/1998 | DiTullio | |
| 5,890,838 | A | 4/1999 | Moore, Jr. et al. | |
| 6,129,482 | A | 10/2000 | DiTullio | |
| 6,322,288 | B1 | 11/2001 | DiTullio | |
| 6,361,248 | B1 | 3/2002 | Maestro | |
| 6,612,777 | B2 | 9/2003 | Maestro | |
| 7,226,241 | B2 | 6/2007 | DiTullio | |
| 2002/0025226 | A1 | 2/2002 | Maestro | |
| 2007/0258770 | A1 | 11/2007 | Miskovich | |
| 2008/0181725 | A1 * | 7/2008 | Miskovich | 405/49 |
| 2009/0097921 | A1 * | 4/2009 | Hetzler et al. | 405/119 |

FOREIGN PATENT DOCUMENTS

| | | | |
|---|---|---|---|
| DE | 2114490 | A1 | 10/1972 |
| EP | 0009835 | A1 * | 4/1980 |

OTHER PUBLICATIONS

Cultec, Inc.; Cultec Patented Interlocking Rib Connection (printout from www.cultec.com web pages); Oct. 2001.
Cultec, Inc.; Plastic Septic and Stormwater Chambers (printout from www.cultec.com web pages); Sep. 2002.
St. Marseille, J.G.; Anderson, B.C.; "Use of Leaching Chambers for On-Site Sewage Treatment"; 2002; Environmental Technology, vol. 23, pp. 261-272.
Great Britain Search Report; Application No. GB1109710.2; Issued Jul. 8, 2011; 1 page.

* cited by examiner

*Primary Examiner* — David Bagnell
*Assistant Examiner* — Kyle Armstrong
(74) *Attorney, Agent, or Firm* — St. Onge Steward Johnston & Reens LLC

(57) ABSTRACT

A drainage system includes a storm water chamber and floor liner assembly for storing and conveying liquids. The storm water chamber comprises a generally elongated arch shape with an arch top and bottom side walls, thereby defining an enclosure, the enclosure having a plurality of liquid intake openings. The floor liner comprises two generally parallel sides each having a plurality of retaining members for connecting the storm water chamber. When the storm water chamber and floor liner are connected with each other, the system provides a substantially enclosed assembly for conveying liquids.

23 Claims, 6 Drawing Sheets

STORM WATER CHAMBER WITH FLOOR LINER

FIELD OF THE INVENTION

The present invention relates to a system for conveying or collecting liquids and, more particularly, to liquid conveyance chambers for conveying storm water for collection or dispersal.

BACKGROUND OF THE INVENTION

Various methods, systems and apparatus are known to handle wastewater and/or storm water. Culverts, catch basins, storm sewers and outfalls have been used. Although such systems provide substantial advantages over direct discharge into an existing water body, they preclude other uses of the land. This is particularly important where land values are high such as in urban, residential and industrial areas. In addition, such known approaches have adverse environmental effects, for example, by lowering local water tables when storm water is prohibited from dispensing into the earth.

Consequently, it is desirable to direct rain or storm water into the earth. This has typically been done by using infiltration trenches filled with large gravel or crushed stone with perforated pipes running therethrough. However, stone filled trench systems are expensive and inefficient since the stone occupies a substantial volume, limiting the ability of the system to handle large surge volumes of water associated with heavy storms. Both the stone and the perforated pipe are also susceptible to clogging by particles or debris carried by water.

In order to solve such problems and disadvantages, underground drainage chambers have been introduced in the market for handling storm water or sewage system effluent, although not limited thereto. Such chambers typically have an arch-shaped cross-section and are relatively long with open bottoms for dispersing water to the ground. These chambers may be laid on a gravel bed side-by-side in parallel rows to create large drainage systems. End portions of the chambers may be connected to a catch basin, typically through a pipe network, in order to efficiently distribute high velocity storm water.

Storm water chambers have been used for gathering and dispensing liquids such as, for example, storm water and waste water into the ground. Such storm water chambers are disclosed in U.S. Pat. No. 7,226,241, entitled STORM WATER CHAMBER FOR GANGING TOGETHER MULTIPLE CHAMBERS, assigned to Cultec, Inc., which this application incorporates by reference in its entirety.

When large drainage systems are built away from the collection point, it can be difficult to convey the liquid to the drainage system for proper dispersal. As an example, a large shopping development may have a parking lot that collects storm water and a large drainage system built some distance away. Therefore, the liquid collected from the parking lot must be conveyed to the drainage system. Conveying that storm water to the drainage system for proper liquid dispersal can require a sophisticated and expensive system of piping. Pipes may also clog easily as refuse, leaves and other objects are carried by the water into the pipes.

Therefore, it would be beneficial to have a superior system for liquid storage and conveyance through the use of a storm water chamber with floor liner and method of use.

SUMMARY OF THE INVENTION

The needs set forth herein as well as further and other needs and advantages are addressed by the present embodiments, which illustrate solutions and advantages described below.

The system according to the present teachings includes, but is not limited to, a storm water chamber having a first end, a second end, and two side walls running the length between the first end and second end, with each side wall having a bottom portion. The storm water chamber has a generally elongated arch shape between the side walls with an arch top, thereby defining an enclosure. The storm water chamber also has a chamber connector member on the second end for connecting a further storm water chamber, a plurality of liquid intake openings, and a plurality of circumferential reinforcing members disposed along the generally elongated arch shape for reinforcing structural strength thereof. A floor liner has two ends and two sides defining an area therebetween, with a plurality of raised portions within the area between the two sides. The floor liner also has a plurality of retaining members on each side for connecting the bottom portions of the two side walls of the storm water chamber, and a floor liner connector member on one end for connecting a further floor liner. A substantially enclosed assembly is created when the liquid dispersing chamber is connected with the floor liner and liquid directed into the assembly may be stored or conveyed in a predetermined direction.

Other embodiments of the system are described in detail below and are also part of the present teachings.

For a better understanding of the present embodiments, together with other and further aspects thereof, reference is made to the accompanying drawings and detailed description, and its scope will be pointed out in the appended claims.

DETAILED DESCRIPTION OF THE INVENTION

The present teachings are described more fully hereinafter with reference to the accompanying drawings, in which the present embodiments are shown. The following description is presented for illustrative purposes only and the present teachings should not be limited to these embodiments.

Figure 1:
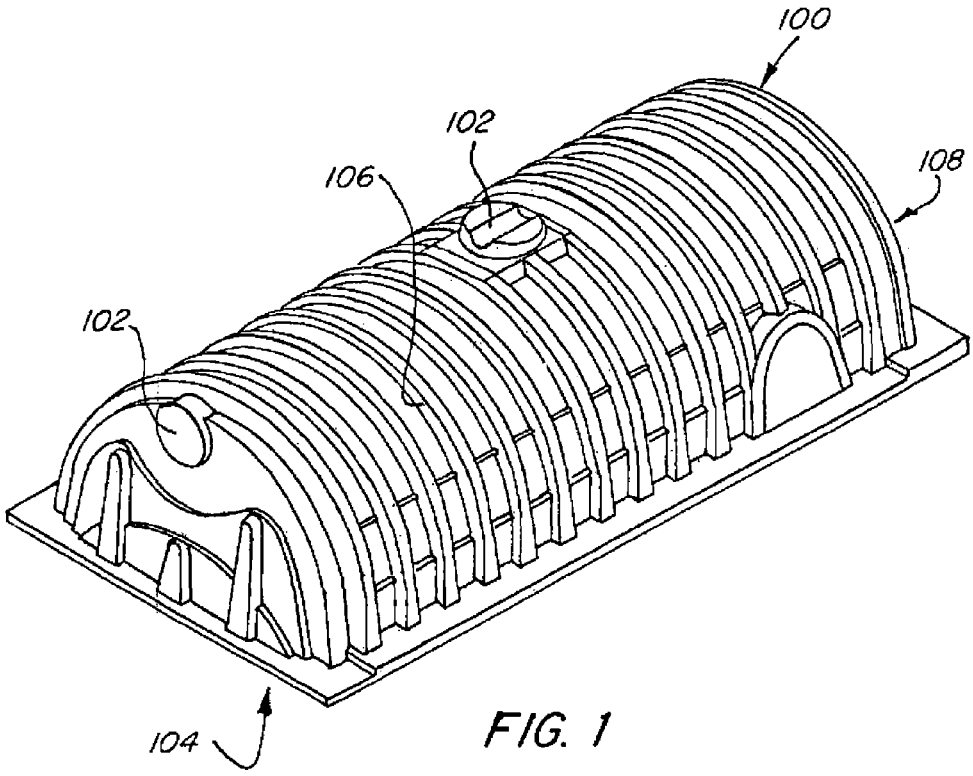
FIG. 1 is a perspective view of one embodiment of a storm water chamber according to the present teachings.

Referring now to FIG. 1, shown is a perspective view of one embodiment of a storm water chamber 100 according to the present teachings. Storm water chambers 100 may be used to help collect wastewater, storm water, or some other liquids for storage or dispersal. The storm water chamber 100 may have liquid intake openings 102 on its end or top, although not limited thereto. In fact, the liquid intake openings 102 could be designed for placement anywhere on the storm water chambers 100 according to the particular need, and the present teachings are not limited to this particular embodiment. Liquid that enters the liquid intake opening 102 may flow through the storm water chamber 100 along its length and disperse through an open bottom 104 to the earth. Similarly, the storm water chambers 100 may be used to store liquid instead of dispersing it.

The storm water chamber 100 is shaped to provide desirable characteristics of chamber volume and strength. It may have a generally elongated arch shape with an arch top and bottom side walls, and may have two, one or no end walls. The storm water chamber 100 defines an enclosure which may be fully enclosed or open on one or both ends. A plurality of circumferential reinforcing members are disposed along the generally elongated arch shape for reinforcing structural strength thereof. The reinforcing members may be ribs 106, although not limited thereto. The storm water chambers 100 are shaped so as to be stackable and nestable, e.g. a plurality of the storm water chambers 100 can be nested together in a stack.

Additional storm water chambers 100 may be connected on an engaging end 108 to create a long, further extendable series of chambers for dispersing liquid over a larger area, discussed further below. If the storm water chamber 100 has ribs 106, one or more of the ribs 106 on the engaging end 108 may be smaller in size, or configured in some other way to accept engagement of a further storm water chamber 100, which may overlap it, for example.

Figure 2:
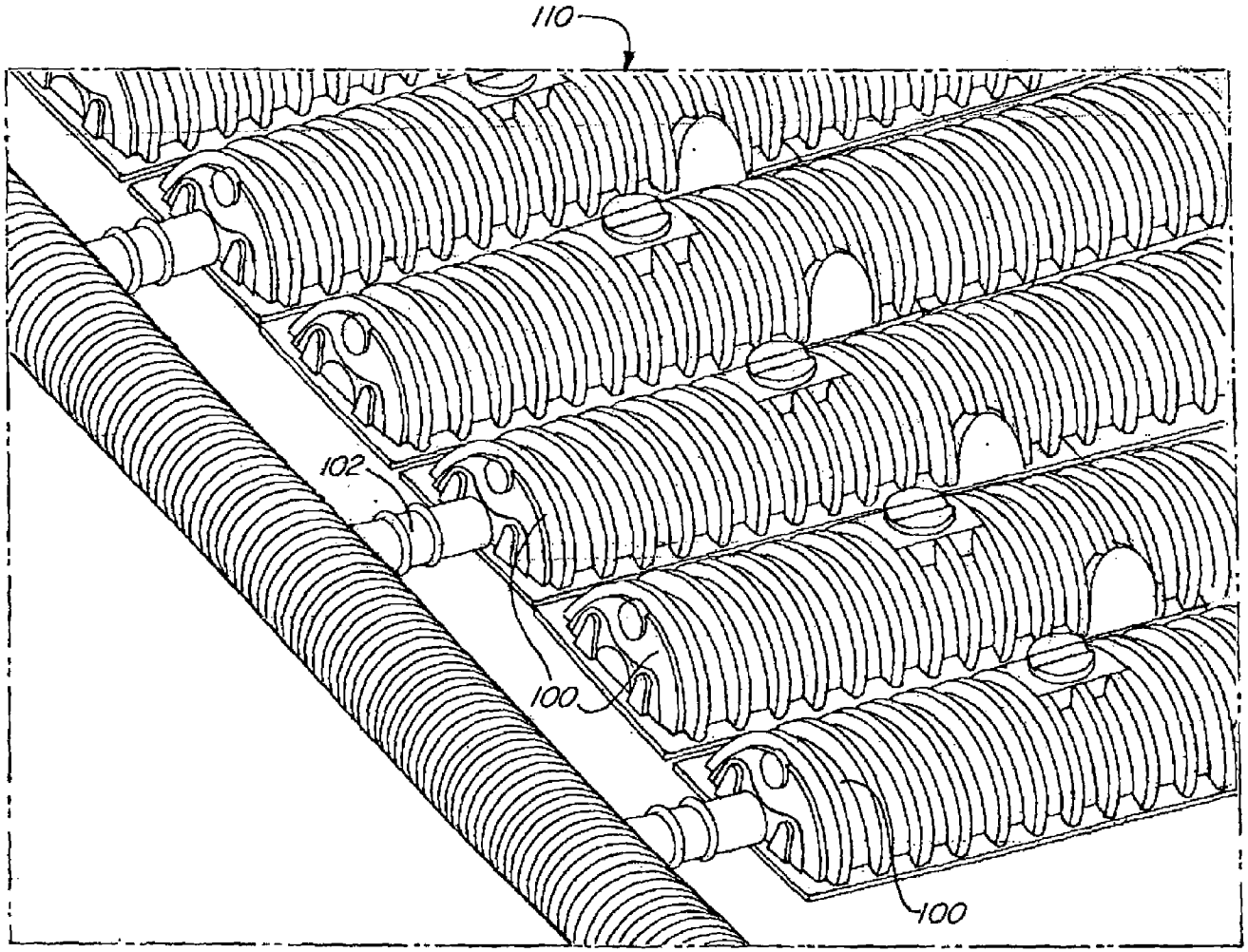
FIG. 2 is a perspective view of one embodiment of a large drainage system incorporating storm water chambers according to the present teachings.

Referring now to FIG. 2, shown is a perspective view of one embodiment of a large drainage system 110 incorporating storm water chambers 100 according to the present teachings. The modular design of the storm water chamber 100 permits the creation of an extendable system that can disperse liquid over a wide area of ground. Each storm water chamber 100 may connect with each other at an engaging end 108 (shown in FIG. 1) to extend the system. Liquids entering an intake opening 102 can then travel through the series of chambers and disperse through an open bottom 104 (shown in FIG. 1). So constructed, the large drainage system 110 may be covered with earth so as not to occupy valuable ground surface area. Ribs 106 (shown in detail in FIG. 1) may help strengthen the storm water chambers 100 to support any additional weight.

Figure 3:
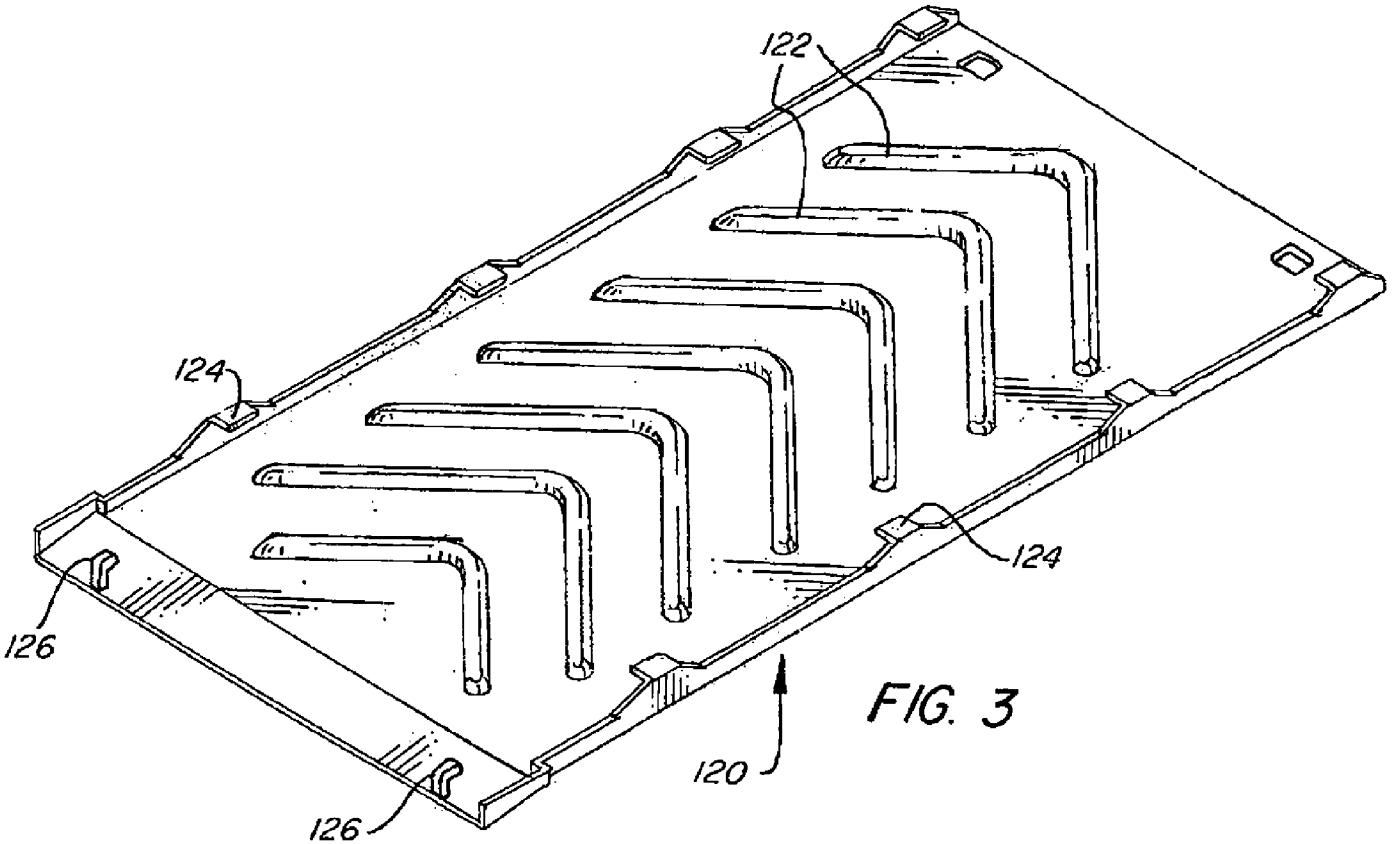
FIG. 3 is a perspective view of one embodiment of a floor liner according to the present teachings.

Referring now to FIG. 3, shown is a perspective view of one embodiment of a floor liner 120 according to the present teachings. The floor liner 120 may be manufactured with a heavy duty material similar to that used to manufacture the storm water chamber 100 (shown in FIG. 1). For example, although not limited thereto, it may be manufactured from polyethylene, polyvinyl chloride (PVC), or any number of types of plastics or metals. The floor liner 120 preferably has a shape which corresponds with the open bottom 104 of the storm water chamber 100. As shown, the floor liner 120 is in a generally rectangular shape.

The floor liner 120 may have a generally flat bottom in order to make it more stable. This provides many benefits over the use of pipe systems when the floor liner 120 and storm water chamber 100 are connected to convey or store liquids, discussed further below. Pipes, in particular, are unstable and prone to shifting and breaking when the ground around them erodes. The floor liner 120 may be constructed with a plurality of raised portions 122. Raised portions 122 may help direct liquid flow, trap sediment and increase the strength of the floor liner 120, although not limited thereto. The floor liner 120 may further be constructed with retaining members 124 or clips (e.g., snaps, straps, screw holes, clamps, etc.) for securing the storm water chamber 100, discussed further below.

The floor liner 120 may also have a connector 126 member on its end or ends in order to connect additional floor liners 120 in a series. In one embodiment, the connector 126 member may be a portion of the floor liner 120 that overlaps a corresponding portion in a further floor liner 120. In this way, the overlap may hold the two floor liners 120 together. The connector 126 member may comprise hooks that interact with corresponding holes (as shown), straps, buckles, screws, tabs, or any other means for holding two floor liners 120 together, and the present teachings are not limited to this particular embodiment. This may be helpful when constructing a large drainage system 110 (shown in FIG. 2) or creating a series of floor liner 120 and storm water chamber 100 assemblies in order to convey liquid to a large drainage system 110. Connecting multiple storm water chambers 100 and floor liners 120 in series allow liquid to be conveyed or stored (e.g., liquid not permitted to disperse through the chamber's bottom) over a large area.

Figure 4:
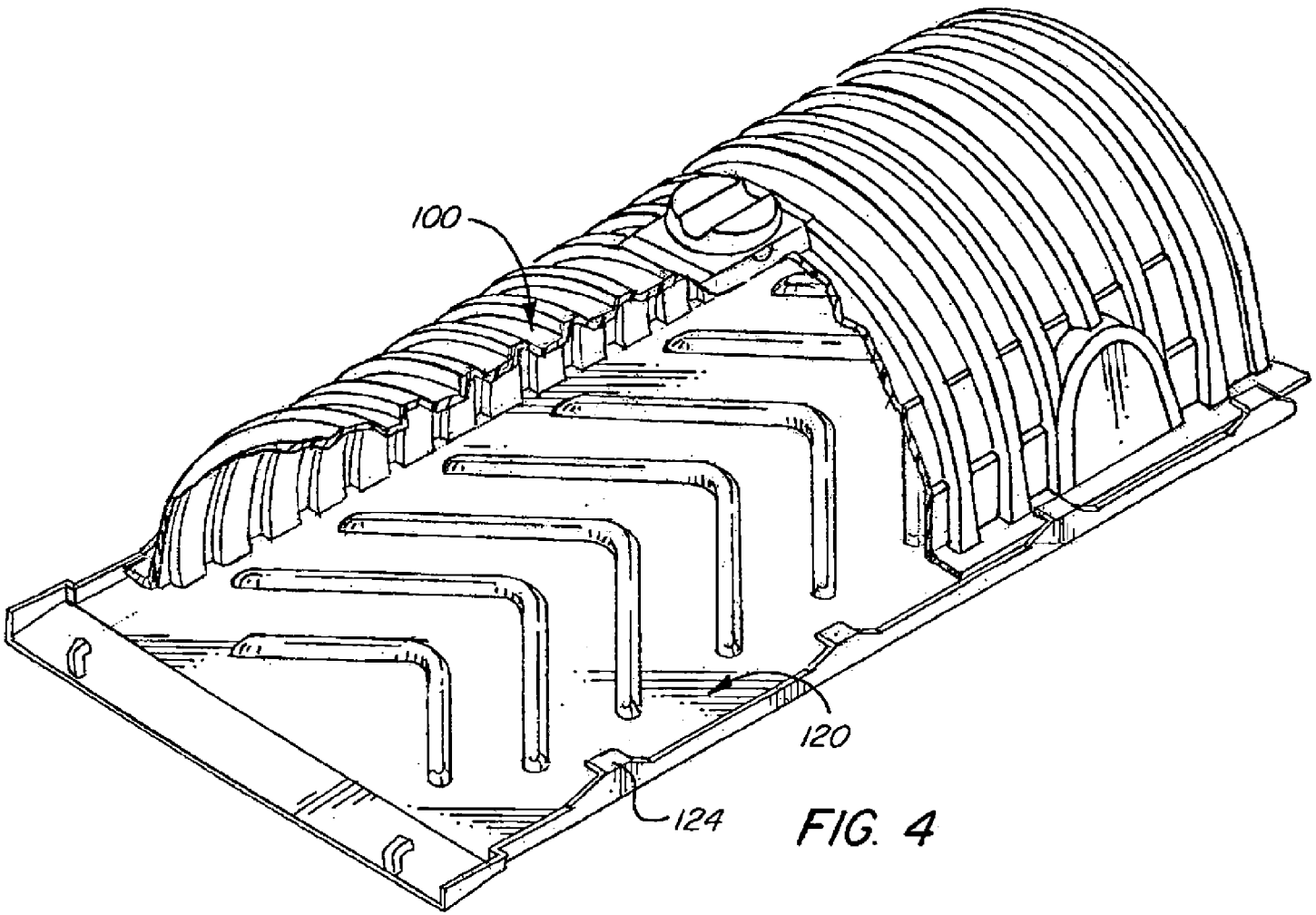
FIG. 4 is a cutout perspective view of one embodiment of a storm water chamber and floor liner according to the present teachings.

Referring now to FIG. 4, shown is a cutout perspective view of one embodiment of a storm water chamber 100 and floor liner 120 according to the present teachings. The storm water chamber 100 and floor liner 120 cooperate with each other in order to create a solitary assembly for storing or conveying liquid. Since both the floor liner 120 and storm water chamber 100 can be extended by connecting further floor liner 120 and storm water chamber 100 assemblies, the solitary structure provides the ability to store liquids over a long distance or mimic the benefits of traditional piping by conveying liquids over a long distance. However, the system described herein may be manufactured, shipped and installed less expensively and without the need for professional installers as with traditional pipe systems. In particular, extruded plastic pipe in the sizes typically used for storm water control systems is a large diameter tube which occupies a substantial volume when it is transported. It will often take multiple truck load deliveries to deliver the required amount of pipe to a worksite. In contrast, the present invention allows a more economical and fuel efficient worksite installation because the storm water chambers 100 are nestable with each other so that the required number of chambers can be stacked on a delivery truck bed and delivered in a single truckload. Optionally, the floor liners 120 are also nestable and stackable for efficient worksite delivery in the same way, however, this is an optional aspect of the invention since the relatively flat floor liners 120 will not occupy delivery truck volume to the same degree as the storm water chambers 100.

Storm water chambers 100 and floor liners 120 may be constructed in any number of different sizes, shapes and thicknesses for a particular purpose. For example, although not limited thereto, the structure may be buried around the perimeter of a building, such as a residence. Since the dispensing chamber 100 may have liquid intake openings 102 on its top, rain gutters from the building may drain directly into the system, which may then convey the rain water to a drainage area built a distance away from the building. For this purpose, the dispensing chamber 100 and floor liner 120 assembly may only need to be between 12 and 36 inches in width. However, if designed for a large big box store or other large commercial or industrial application, the dispensing chamber 100 and floor liner 120 assembly may be between two and six feet in width. It is appreciated that the assembly could be designed in any size for a particular purpose and it is not limited to these particular embodiments.

Generally, it may be preferable to position the storm water chambers 100 and floor liners 120 over bed of gravel at a slight grade so that the liquid will flow in a predetermined direction. The use of the system described herein helps to prevent erosion resulting from high volume low velocity flows. And since storm water chambers 100 may have liquid intake openings 102 on its top, no expensive pipe Ts are needed. Instead, a pipe, gutter, etc., may drain directly into the system's liquid intake openings 102.

Figure 5:
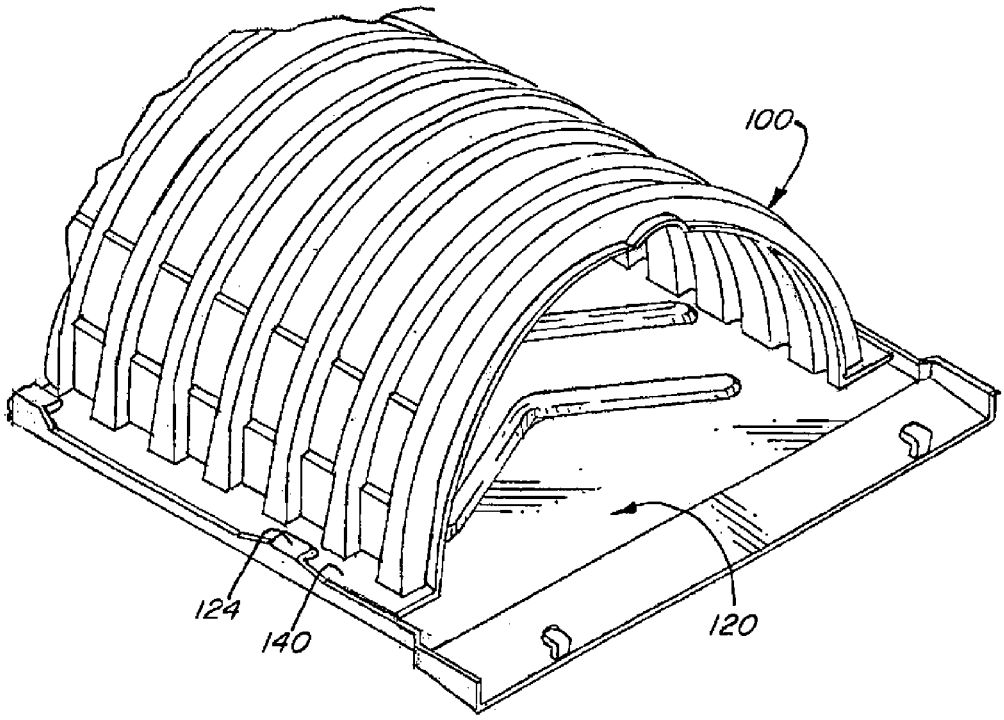
FIG. 5 is a perspective end view depicting the connection of a liquid dispending chamber and a floor liner in one embodiment according to the present teachings.

Referring now to FIG. 5, shown is a perspective end view depicting the connection of a liquid dispending chamber 100 and a floor liner 120 in one embodiment according to the present teachings. The floor liner 120 may have retaining members 124 (e.g., clips, etc.) which interact with a corresponding bottom portion 140 or lip of the liquid dispending chamber 100 in order to secure the two pieces to each other. It is appreciated that any number of different methods could be used to secure the liquid dispending chamber 100 with the floor liner 120 including snaps, straps, clamps, screws, a flange, etc., and the present teaching are not limited to this particular embodiment. It is desirable that the means for securing the liquid dispending chamber 100 with the floor liner 120 holds them adjacent to one another so that liquid travelling through the unified assembly does not easily escape.

Figure 6:
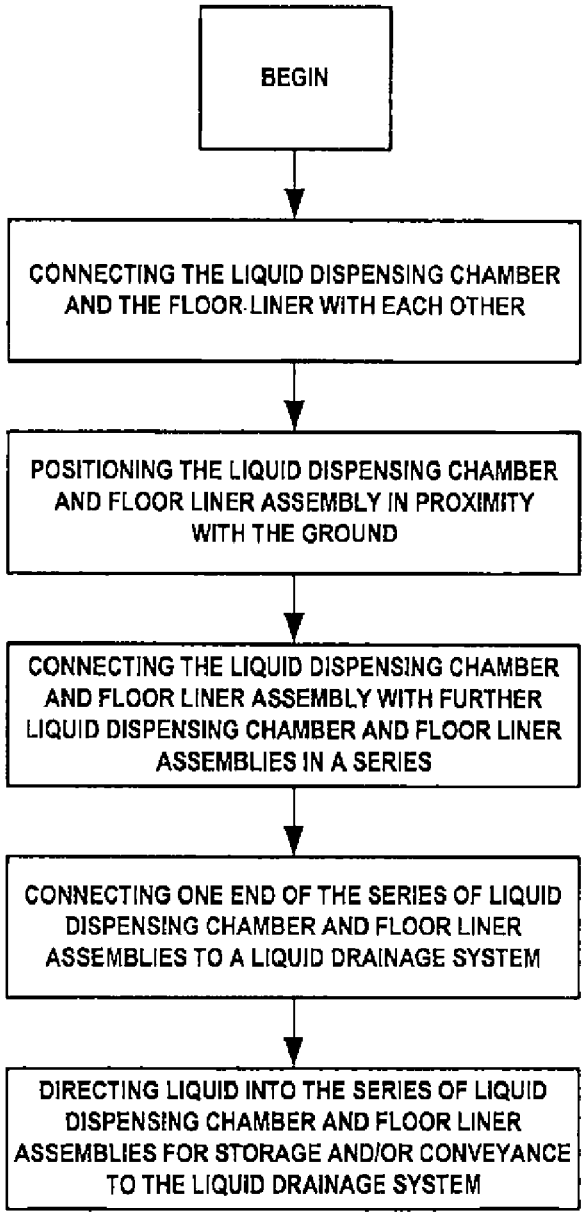
FIG. 6 is a flowchart depicting one embodiment of a method of using the floor liner according to the present teachings.

Referring now to FIG. 6, shown is a flowchart depicting one embodiment of a method of using the floor liner according to the present teachings. The following steps may be performed to use the system disclosed herein, although not limited thereto: connect the liquid dispersing chamber and the floor liner with each other; position the storm water chamber and the floor liner assembly in proximity with the ground; and direct liquid into the storm water chamber and floor liner assembly for storage and/or conveyance. Further storm water chambers and floor liners may be connected with the assembly in order to create a series of assemblies. The series may be connected to a liquid drainage system for conveying liquid thereto.

While the present teachings have been described above in terms of specific embodiments, it is to be understood that they are not limited to these disclosed embodiments. Many modifications and other embodiments will come to mind to those skilled in the art to which this pertains, and which are intended to be and are covered by both this disclosure and the appended claims. It is intended that the scope of the present teachings should be determined by proper interpretation and construction of the appended claims and their legal equivalents, as understood by those of skill in the art relying upon the disclosure in this specification and the attached drawings.

What is claimed is:

1. A drainage system, comprising:

a storm water chamber having a generally elongated arch shape with sidewalls defining an enclosure; and having a chamber connector member on one end for connecting a further storm water chamber; and a floor liner having two ends and two sides defining an area therebetween;

a plurality of retaining members on each side for connecting the bottom portions of the two sidewalls of the storm water chamber; and said chamber and floor liner providing a liquid conveying assembly;

said floor liner having a plurality of raised portions in the enclosure within the area between the two sides of the floor liner, said floor liner two sides defining a floor liner width, said plurality of raised portions having a width which is less than the floor liner width, said raised portions being non-perpendicular to a central longitudinal axis of the floor liner.

2. The drainage system of claim 1, wherein the storm water chamber is stackable with further storm water chambers for efficient shipping.

3. The drainage system of claim 2, wherein the floor liner has a plurality of raised portions within an area bounded by the two sides of the floor liner.

4. The drainage system of claim 3, wherein the floor liner's plurality of retaining members comprises clips which cooperate with a lip on the storm water chamber.

5. The drainage system of claim 3, wherein the floor liner is provided with a floor liner connector member on one end for connecting a further floor liner.

6. The drainage system of claim 5, wherein the floor liner connects with the further floor liner by at least partially overlapping it.

7. The drainage system of claim 3, wherein the floor liner comprises a plastic material.

8. The drainage system of claim 1, wherein the storm water chamber has a plurality of circumferential reinforcing rib members.

9. The drainage system of claim 1, wherein the storm water chamber connects with the further storm water chamber by at least partially overlapping it.

10. A drainage system, comprising:

a plurality of storm water chambers having a generally elongated arch shape with sidewalls defining an enclosure; and connected to each other by overlapping ribs; and a plurality of floor liners having two ends and two sides defining an area therebetween;

a plurality of retaining members on each side for connecting the bottom portions of the two sidewalls of the storm water chambers;

said plurality of floor liners having a plurality of raised portions in the enclosure within the area between the two sides of the floor liners, said floor liner two sides defining a floor liner width, said plurality of raised portions having a width which is less than the floor liner width, said raised portions being non-perpendicular to a central longitudinal axis of the floor liner.

11. The drainage system of claim 10, wherein the storm water chambers are nestingly stackable for efficient shipping.

12. The drainage system of claim 10, wherein the floor liner have a plurality of raised portions within an area bounded by the two sides of the floor liner.

13. The drainage system of claim 12, wherein the floor liners' plurality of retaining members comprises clips which cooperate with lips on the storm water chambers.

14. The drainage system of claim 13, wherein the floor liners are provided with a floor liner connector member on one end for connecting to other floor liners.

15. The drainage system of claim 14, wherein the floor liners connect with other floor liners by at least partially overlapping them.

16. The drainage system of claim 15, wherein the floor liners comprises a plastic material.

17. The drainage system of claim 16, wherein the storm water chambers have a plurality of circumferential reinforcing rib members.

18. A method of using a drainage system, the system comprising:

a storm water chamber having a first end and a second end;

two side walls running the length between the first end and second end, each side wall having a bottom portion;

a generally elongated arch shape between the side walls with an arch top, thereby defining an enclosure;

a chamber connector member on the second end for connecting a further storm water chamber;

a plurality of liquid intake openings; and a plurality of circumferential reinforcing members disposed along the generally elongated arch shape for reinforcing structural strength thereof; and a floor liner having two ends and two sides defining an area therebetween;

a plurality of raised portions in the enclosure within an area bounded by the two sides, said floor liner two sides defining a floor liner width, said plurality of raised portions having a width which is less than the floor liner width, said raised portions being non-perpendicular to a central longitudinal axis of the floor liner;

a plurality of retaining members on each side for connecting the bottom portions of the two side walls of the storm water chamber; and a floor liner connector member on one end for connecting a further floor liner;

wherein a substantially enclosed assembly is created when the liquid dispersing chamber is connected with the floor liner;

whereby liquid directed into the assembly is stored or conveyed in a predetermined direction;

the steps comprising:

connecting the storm water chamber with the floor liner;

positioning the storm water chamber and the floor liner in proximity with the ground; and directing liquid into the storm water chamber and the floor liner assembly for storage and/or dispersal.

19. The method of claim 18, further comprising the step of connecting a further storm water chamber and floor liner assembly to create a series.

20. The method of claim 19, further comprising the step of connecting the series to a large drainage system.

21. The method of claim 20, wherein the floor liner's plurality of retaining members comprises clips which cooperate with a lip on the storm water chamber.

22. The method of claim 21, wherein the floor liner connects with the further floor liner by at least partially overlapping it.

23. The method of claim 22, wherein the floor liner comprises a plastic material.

* * * * *